US008312680B2

(12) United States Patent
Krahn et al.

(10) Patent No.: US 8,312,680 B2
(45) Date of Patent: Nov. 20, 2012

(54) GROUND ANCHOR PROVIDING MINIMAL GROUND DISTURBANCE

(75) Inventors: Jairus Krahn, High Level (CA); Terry Mundle, Cochrane (CA)

(73) Assignee: R U Grounded Energy Inc., Calgary (CA)

( * ) Notice: Subject to any disclaimer, the term of this patent is extended or adjusted under 35 U.S.C. 154(b) by 1163 days.

(21) Appl. No.: 11/169,988

(22) Filed: Jun. 28, 2005

(65) Prior Publication Data

US 2006/0107605 A1 May 25, 2006

(30) Foreign Application Priority Data

Nov. 19, 2004 (CA) ..... 2485815

(51) Int. Cl.
*E02D 5/74* (2006.01)

(52) U.S. Cl. ..... 52/155; 52/148

(58) Field of Classification Search ..... 52/155, 52/165, 148, DIG. 11; 248/545, 156; 5/417; 37/344, 345, 452; 135/118; 404/6; 411/457, 411/422–444, 459–461
See application file for complete search history.

(56) References Cited

U.S. PATENT DOCUMENTS

| | | | | |
|---|---|---|---|---|
| 729,591 | A | 6/1903 | Jacob | |
| 1,316,323 | A | 9/1919 | Poole | |
| 1,721,436 | A | 7/1929 | Dubois et al. | |
| 1,982,572 | A * | 11/1934 | Colglazier et. al. | 182/107 |
| 2,870,884 | A * | 1/1959 | Mazur | 52/158 |
| 3,118,416 | A * | 1/1964 | Sawyer | 114/297 |
| 3,485,137 | A | 12/1969 | Clements | |
| 4,679,369 | A | 7/1987 | Kinsley et al. | |
| 4,708,086 | A * | 11/1987 | Brown, Jr. | 114/294 |
| 4,776,140 | A * | 10/1988 | Wight et al. | 52/125.5 |
| 5,444,949 | A * | 8/1995 | Ciaccio | 52/155 |
| 5,515,656 | A | 5/1996 | Mihalich | |
| 5,984,587 | A * | 11/1999 | Odle | 405/244 |
| 6,591,564 | B2 * | 7/2003 | Cusimano | 52/274 |
| 6,619,307 | B2 | 9/2003 | Orr | |
| 7,047,696 | B2 * | 5/2006 | DiDomenico | 52/166 |
| 7,213,869 | B1 * | 5/2007 | McClellan | 296/161 |

* cited by examiner

*Primary Examiner* — Brian Glessner
*Assistant Examiner* — Adriana Figueroa
(74) *Attorney, Agent, or Firm* — Christensen O'Connor Johnson Kindness PLLC

(57) ABSTRACT

A ground anchor, including a body having an upper surface and a lower surface, ground piercing members depending from the lower surface of the body, the ground piercing members being adapted to engage an underlying ground surface and prevent movement of the body along such ground surface, ballast positioned on or in the body, the ballast being sufficient to maintain the ground piercing members engaged with the ground surface when under load, and means for securing an anchor line to the body.

7 Claims, 3 Drawing Sheets

GROUND ANCHOR PROVIDING MINIMAL GROUND DISTURBANCE

FIELD OF THE INVENTION

The present invention relates to a ground anchor for use in environmentally sensitive areas; that is capable of anchoring with minimal ground disturbance.

BACKGROUND OF THE INVENTION

There are some geographic areas which are designated as environmentally sensitive areas and are protected by law. Work, such as oil and gas drilling, in environmentally sensitive areas requires a special permit. The special permit is only granted upon condition that there be minimal ground disturbance. Even in areas which are not designated as environmentally sensitive areas, property owners are increasingly imposing conditions relating to minimal ground disturbance when granting access to their property.

SUMMARY OF THE INVENTION

What is required is a ground anchor providing minimal ground disturbance.

According to the present invention there is provided a ground anchor, which includes a body having an upper surface and a lower surface. Ground piercing members depend from the lower surface of the body. The ground piercing members are adapted to engage an underlying ground surface and prevent movement of the body along such ground surface. Ballast is positioned on or in the body. The ballast is sufficient to maintain the ground piercing members engaged with the ground surface when under load. Means are provided for securing an anchor line to the body.

With the ground anchor, as described above, the ground piercing members are relatively shallow and cause minimal ground disturbance. The relatively shallow ground piercing members will hold, as long as sufficient ballast is provided to maintain the ground piercing members engaged with the ground surface when under load.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
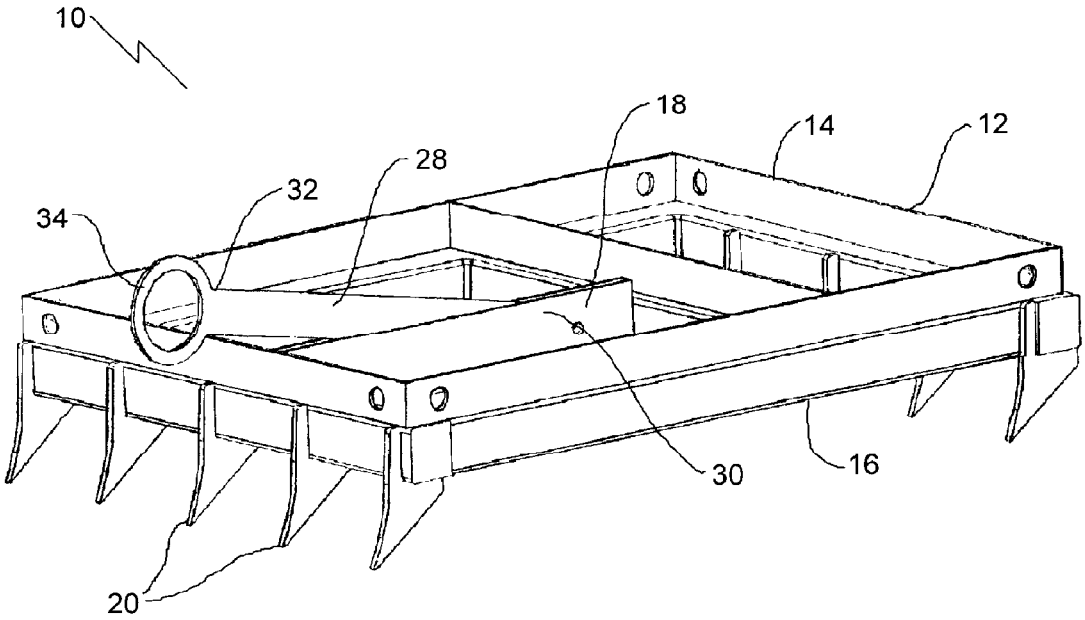
FIG. 1 is a perspective view of a ground anchor constructed in accordance with the teachings of the present invention.

The preferred embodiment, a ground anchor generally identified by reference numeral 10, will now be described with reference to FIGS. 1 and 2.

Figure 2:
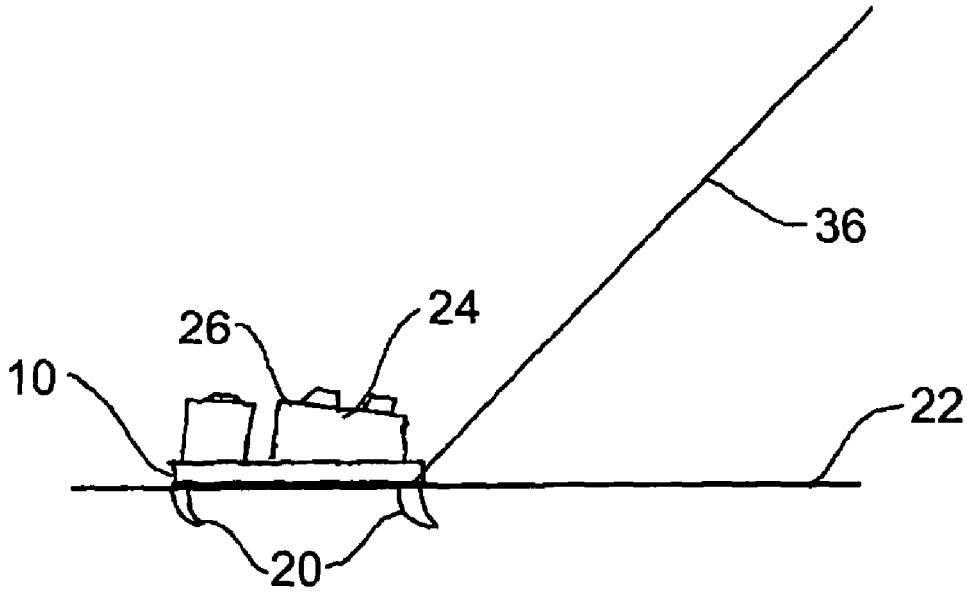
FIG. 2 is a side elevation view of the ground anchor illustrated in FIG. 1 in use anchoring a rig structure.

Structure and Relationship of Parts:

Referring now to FIG. 1, there is shown ground anchor 10 including a body 12 having an upper surface 14, a lower surface 16 and a center of gravity 18. There are ground piercing members 20 depending from lower surface 16 of body 12. Ground piercing members 20 are adapted to engage an underlying ground surface and have an orientation that provides more resistance in a first direction, than in a second direction. Referring to FIG. 2, ground piercing members 20 prevent movement of body 12 along ground surface 22. A ballast 24 may be positioned on or in body 12 that is sufficient to maintain ground piercing members 20 engaged with ground surface 22 when under load. As shown in FIG. 2, ballast 24 is a stack of weights 26 positioned on upper surface 14 of body 12. Referring to FIG. 1, ground anchor 10 also includes an arm 28 having an attachment end 30 and a remote end 32, where attachment end 30 is pivotally attached to body 12 at approximately the center of gravity 18 and has an attachment ring 34 at remote end 32 of arm 28 that provides means for securing an anchor line 36 to body 12 as shown in FIG. 2.

Operation:

The use and operation of ground anchor 10 will now be discussed with reference to FIGS. 1 and 2. Referring to FIG. 2, ground anchor 10 is placed in the desired position, and ground piercing members 20 engage underlying surface 22. Weights 26 are positioned on upper surface 14 of body 12 to maintain ground piercing members 20 engaged with ground surface 22. Anchor line 36 is then attached to ground anchor 10. Referring to FIG. 1, anchor line 26 (not shown in FIG. 1) is attached to attachment ring 34 at remote end 32 of arm 28. Arm 28 is pivotally attached by attachment end 30 to body 12 such that different angles may be accommodated.

Figure 3:
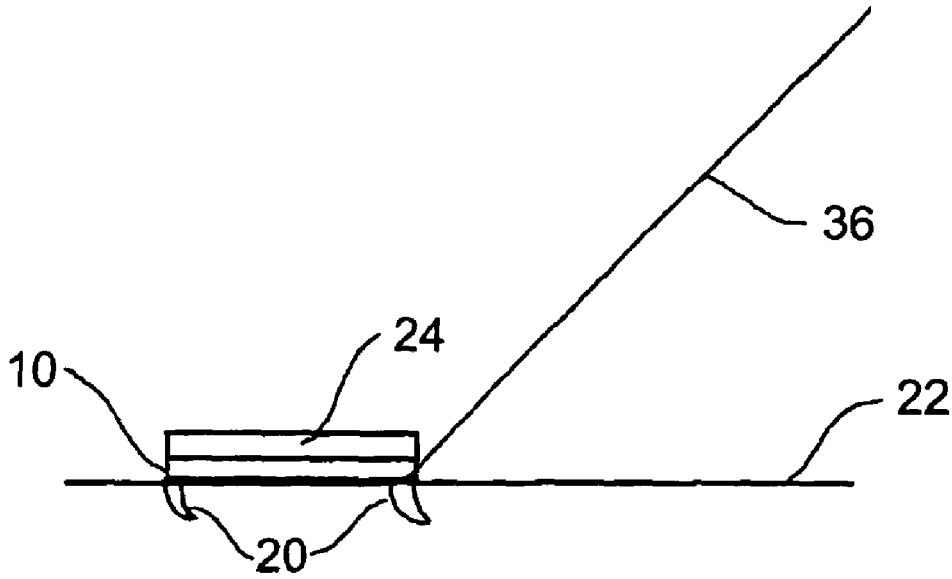
FIG. 3 is a side elevation view of a variation of the ground anchor illustrated in FIG. 1 in use anchoring a rig structure.

Variations:

A variation will now be discussed with reference to FIG. 3. In FIG. 2, ballast 24 is shown to be weights 26 that are positioned on upper surface 22. These weights are removable and separately transportable, which can make it easier to transport and position ground anchor 10. However, referring to FIG. 3, ballast 24 may also be integrally formed into body 12.

Figure 4:
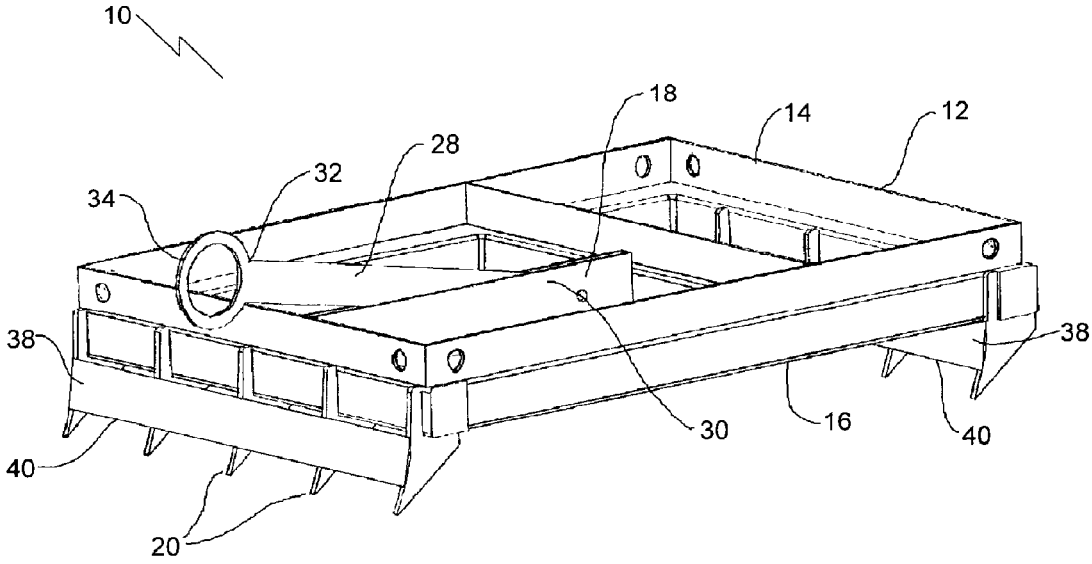
FIG. 4 is a perspective view of a variation of the ground anchor illustrated in FIG. 1.

Another variation is shown in FIG. 4, where a metal plate 38 or bar has been attached to ground engaging members 20. Metal plate 38 has a cutting edge 40 to allow the apparatus to be inserted into the ground more easily. Metal plate 38 acts as a member to increase the surface area perpendicular to the line of force to provide more resistance to movement. It will be understood that other means of increasing the perpendicular surface area are possible, for example, adding flanges to each side of each ground engaging members 20.

Cautionary Warnings:

A force exerted upon the ground anchor will have a vertical force component or vector and a horizontal force component or vector. The ability of the ground anchor to hold when under load is dependent upon there being sufficient ballast to overcome the vertical force component, that would otherwise pull the ground piercing members out of the ground surface. It is also dependent upon the ground piercing members engaging the ground surface providing sufficient resistance to overcome the horizontal force component. One must review the soil conditions, as the resistance provided by the ground piercing members will vary with the soil conditions. One must also ensure that there is sufficient ballast on the body for the ground anchor to overcome any anticipated intermittent additional loads, such as those that may be caused by wind gusts.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A ground anchor, comprising:

a body having an upper surface and a lower surface;

ground piercing members in the form of rows of spaced-apart individual teeth rigidly fixed to and depending from the lower surface of the body;

at least one ground piercing blade member secured to and spanning between an upper portion of the teeth;

ballast positioned on or in the body; and means for securing an anchor line to approximately a center of gravity of the body;

the teeth having an orientation relative to the at least one blade member which provides more resistance in a first direction perpendicular to the at least one blade member than in an opposed second direction.

2. The ground anchor as defined in claim 1, wherein the ballast is integrally formed into the body.

3. The ground anchor as defined in claim 1, wherein the ballast includes more than one weight, the more than one weight forming a stack on the upper surface of the body.

4. The ground anchor as defined in claim 1, wherein the means for securing an anchor line to the body is an attachment ring.

5. The ground anchor as defined in claim 1, wherein an arm is pivotally mounted to the body with the means for securing an anchor line to the body being positioned at a remote end of the arm.

6. The ground anchor as defined in claim 5, wherein the arm is pivotally mounted at approximately the center of gravity of the body.

7. A ground anchor, comprising:

a body having an upper surface, a lower surface and a center of gravity;

ground piercing members in the form of rows of spaced-apart individual teeth rigidly fixed to and depending from the lower surface of the body;

at least one ground piercing blade member extending transversely across an upper portion of the teeth;

ballast positioned on or in the body, the ballast being a stack of weights positioned on the upper surface of the body;

an arm having an attachment end and a remote end, the attachment end being pivotally attached to the body at approximately the center of gravity;

the teeth having an orientation which provides more resistance in a direction perpendicular to the at least one blade member defined by the arm than in an opposed direction; and an attachment ring at the remote end of the arm providing means for securing an anchor line to the body.

* * * * *